US008494389B2

(12) United States Patent
Takami

(10) Patent No.: US 8,494,389 B2
(45) **Date of Patent: *Jul. 23, 2013**

(54) FIXING APPARATUS COMPRISING CIRCUIT FOR SUPPRESSING HEAT GENERATION ACCORDING TO ROTATION DETECTION SIGNAL

(75) Inventor: Hiroshi Takami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/473,245

(22) Filed: May 16, 2012

(65) Prior Publication Data

US 2012/0224874 A1 Sep. 6, 2012

Related U.S. Application Data

(63) Continuation of application No. 12/108,793, filed on Apr. 24, 2008, now Pat. No. 8,200,113.

(30) Foreign Application Priority Data

Apr. 27, 2007 (JP) ..... 2007-119614

(51) Int. Cl.
*G03G 15/20* (2006.01)

(52) U.S. Cl.
USPC ..... 399/69; 399/33

(58) Field of Classification Search
USPC ..... 399/33, 67, 69, 70, 334, 335, 330, 399/331, 328; 219/216
See application file for complete search history.

(56) References Cited

U.S. PATENT DOCUMENTS 8,200,113 B2 * 6/2012 Takami ..... 399/69
2005/0258158 A1 * 11/2005 Takami et al. ..... 219/216

FOREIGN PATENT DOCUMENTS

| | | | |
|---|---|---|---|
| JP | 61-118780 | A | 6/1986 |
| JP | 02-067580 | A | 3/1990 |
| JP | 07-072696 | A | 3/1995 |
| JP | 07-077851 | A | 3/1995 |
| JP | 2007-047471 | A | 2/2007 |

* cited by examiner

*Primary Examiner* — Walter L Lindsay, Jr.
*Assistant Examiner* — Billy J Lactaoen
(74) *Attorney, Agent, or Firm* — Canon USA, Inc., IP Division

(57) ABSTRACT

A fixing apparatus that conveys a printing medium to a fixing nip portion formed by rotating members, and fixes an image onto the printing medium by heat from heating elements. The fixing apparatus also includes a safety element, a rotation detection circuit, and a limiting circuit. The safety element is in a power supply path to supply electrical power to the heating elements and to shut off the path in response with an abnormal temperature. The rotation detection circuit detects a rotation state of the rotating members. The limiting circuit limits a drive of a second driving circuit per a rotation detection circuit output. A first driving circuit detects that the circuit drives a first heating element per a control signal, regardless of the rotating members rotation state, and the second driving circuit drives a second heating element per a control signal and the output from the rotation detection circuit.

15 Claims, 19 Drawing Sheets

FIG. 6B

| APPLIED POWER [%] | t1 [msec] | t2 [msec] |
|---|---|---|
| 100.0 | 0.00 | 10.00 |
| 97.5 | 1.59 | 11.59 |
| 95.0 | 2.02 | 12.02 |
| 92.5 | 2.33 | 12.33 |
| 90.0 | 2.59 | 12.59 |
| 87.5 | 2.81 | 12.81 |
| 85.0 | 3.01 | 13.01 |
| 82.5 | 3.19 | 13.19 |
| 80.0 | 3.36 | 13.36 |
| 77.5 | 3.52 | 13.52 |
| 75.0 | 3.68 | 13.68 |
| 72.5 | 3.82 | 13.82 |
| 70.0 | 3.96 | 13.96 |
| 67.5 | 4.10 | 14.10 |
| 65.0 | 4.24 | 14.24 |
| 62.5 | 4.37 | 14.37 |
| 60.0 | 4.50 | 14.50 |
| 57.5 | 4.62 | 14.62 |
| 55.0 | 4.75 | 14.75 |
| 52.5 | 4.87 | 14.87 |
| 50.0 | 5.00 | 15.00 |
| 47.5 | 5.13 | 15.13 |
| 45.0 | 5.25 | 15.25 |
| 42.5 | 5.38 | 15.38 |
| 40.0 | 5.50 | 15.50 |
| 37.5 | 5.63 | 15.63 |
| 35.0 | 5.76 | 15.76 |
| 32.5 | 5.90 | 15.90 |
| 30.0 | 6.04 | 16.04 |
| 27.5 | 6.18 | 16.18 |
| 25.0 | 6.32 | 16.32 |
| 22.5 | 6.48 | 16.48 |
| 20.0 | 6.64 | 16.64 |
| 17.5 | 6.81 | 16.81 |
| 15.0 | 6.99 | 16.99 |
| 12.5 | 7.19 | 17.19 |
| 10.0 | 7.41 | 17.41 |
| 7.5 | 7.67 | 17.67 |
| 5.0 | 7.98 | 17.98 |
| 2.5 | 8.41 | 18.41 |
| 0.0 | 10.00 | 20.00 |

FIG. 11B

| PAPER WIDTH (LATERAL DIMENSION) | SUB HEATER POWER RATIO |
|---|---|
| A | 0% |
| B | 30% |
| C | 70% |
| D | 100% |

FIXING APPARATUS COMPRISING CIRCUIT FOR SUPPRESSING HEAT GENERATION ACCORDING TO ROTATION DETECTION SIGNAL

CROSS REFERENCE TO RELATED APPLICATIONS

The present application is a continuation of U.S. patent application Ser. No. 12/108,793, filed on Apr. 24, 2008, which claims priority from Japanese Patent Application No. 2007-119614, filed Apr. 27, 2007, all of which are hereby incorporated by reference herein in their entirety.

BACKGROUND OF THE INVENTION

1. Field of the Invention

The present invention relates to a fixing apparatus incorporated in an image forming apparatus such as a copying machine or printer using electrophotography and, more particularly, to a heat fixing apparatus which heats a recording medium bearing an unfixed image formed on it, thereby fixing the image.

2. Description of the Related Art

Image forming apparatuses such as a copying machine or printer using electrophotography widely use a heat fixing apparatus which heats a recording medium bearing an unfixed image formed on it, thereby fixing the image. Generally, such a heat fixing apparatus often includes a heating element serving as a heat source, a power supply that supplies a current to the heating element, a temperature detection means for detecting the temperature near the heating element, and a control means for controlling the current to be supplied to the heating element. If even one of the heating element, power supply, temperature detection means, and control means fails to normally function, the fixing apparatus cannot normally operate. For example, if energization runaway has occurred, the apparatus may suffer damage due to overheat. In general, a safety element device provided in the fixing apparatus suppresses overheat in the event of energization runaway.

Various techniques have been developed against this problem. As a safety device for de-energizing a heating element, Japanese Patent Laid-Open No. 08-248813 discloses a safety element such as a thermal switch or fuse which is actuated upon detecting an abnormal temperature rise by itself, independently of a system control unit.

However, the actuation of the safety element sometimes delays. For example, the actuation delays if large power is supplied to the heating element in a rotation stop state of a pressing member. In this case, since the amount of heat dissipated from the heating element via the pressing roller decreases, it is high probable that the temperature of the heating element abruptly rises. When the temperature of the heating element abruptly increases, the safety element such as a thermal switch cannot quickly follow the temperature rise. This may cause thermal damage to the apparatus before the safety element is actuated.

Japanese Patent Laid-Open No. 2004-102121 discloses a fixing apparatus which has a rotation detection sensor for detecting the rotation of a heating roller and, in accordance with the rotation state of a control heating roller that controls energization to a coil for making the heating roller generate heat, limits the energization amount to the coil.

When the temperature of the heating roller readily rises abruptly, i.e., when the heating roller stops rotation, the control unit receives a detection result from the rotation detection sensor and stops or decreases the energization amount to the coil.

In the arrangement disclosed in Japanese Patent Laid-Open No. 2004-102121, however, if the control unit fails, the energization amount to the coil cannot be limited. As a result, even when the rotation detection sensor detects the rotation state of the heating roller, the apparatus may suffer thermal damage before the safety element such as a thermal switch is actuated.

SUMMARY OF THE INVENTION

An aspect of the present invention to provide a fixing apparatus capable of reducing the risk of causing thermal damage to the apparatus. It is another aspect of the present invention to provide a fixing apparatus capable of actuating a safety element before the apparatus suffers thermal damage.

According to a first exemplary embodiment of the present invention, a fixing apparatus includes a first heating element, a second heating element, a first rotating member, a second rotating member configured to form a fixing nip portion together with the first rotating member, wherein a printing medium is conveyed to the fixing nip portion, and an image formed on the printing medium is fixed onto the printing medium by heat from the first and second heating elements, a first driving circuit configured to drive the first heating element, a second driving circuit configured to drive the second heating element, a control unit configured to control the first and second driving circuits, a safety element arranged in a power supply path for supplying an electrical power to the first and second heating elements, and configured to shut off the power supply path in response with an abnormal temperature, a rotation detection circuit configured to detect a rotation state of the first and second rotating members and a limiting circuit configured to limit a drive of the second driving circuit in accordance with an output from the rotation detection circuit, wherein the first driving circuit drives the first heating element in accordance with a control signal from the control unit, regardless of the rotation state of the first and second rotating members, and the second driving circuit drives the second heating element in accordance with a control signal from the control unit and the output from the rotation detection circuit.

According to a second exemplary embodiment of the present invention, a fixing apparatus is provided which includes a heating element which generates heat in accordance with power supplied from a power supply; a rotating member which heats an image borne by a recording medium by the heat of the heating element; a pressing member which contacts the rotating member; a driving circuit which switches a power supply line from the power supply to the heating element between an ON state and an OFF state; a control unit which controls the driving circuit to make the heating element maintain a set temperature by outputting a driving signal to the driving circuit; a safety element which is connected in series with the power supply line that connects the heating element to the power supply and de-energizes the heating element upon detecting an abnormal temperature rise of the heating element; a rotation detection circuit which detects a rotation state of one of the rotating member and the pressing member; and a limiting circuit which limits driving of the driving circuit in accordance with an output from the rotation detection circuit. The rotation detection circuit detects that one of the rotating member and the pressing member is not rotating, the limiting circuit limits driving of the driving circuit in accordance with the output from the rotation detection circuit to suppress energization of the heating element regardless of a driving signal from the control unit to the driving circuit.

Further features and aspects of the present invention will become apparent from the following description of exemplary embodiments with reference to the attached drawings.

BRIEF DESCRIPTION OF THE DRAWINGS

FIG. 6B is a table showing the relationship between times t1 and t2 and power applied to the ceramic heater;

FIGS. 11A and 11B are views showing the relationship between the recording medium lateral dimensions and sub heater energization settings;

DESCRIPTION OF THE EMBODIMENTS

Figure 1:
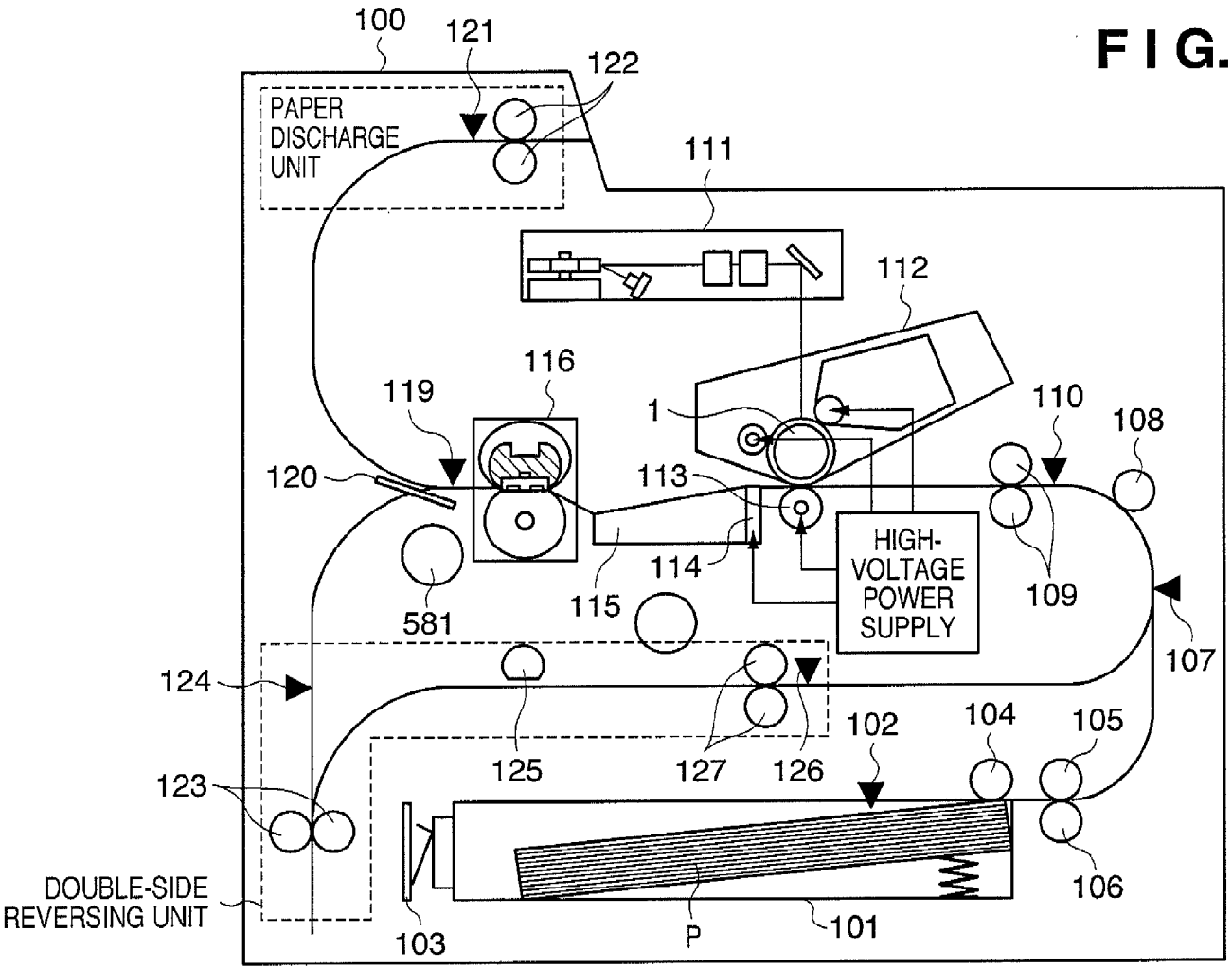
FIG. 1 is a view showing an example arrangement of a laser beam printer according to a first exemplary embodiment of the present invention.

Various embodiments, features and aspects of the present invention will now herein be described in detail with reference to the accompanying drawings. The same reference numerals denote the same and/or similar constituent elements, and a description thereof will not be repeated.

First Exemplary Embodiment

FIG. 1 is a view showing the arrangement of a laser beam printer. As shown in FIG. 1, a laser printer 100 generally includes a plurality of constituent components. Only components related to the embodiment will be given reference numerals and described below. The laser printer 100 includes a deck 101 that stores a recording medium P. A deck paper sensor 102 detects the presence/absence of the recording medium P in the deck 101. A paper size detection sensor 103 detects the size of the recording medium P in the deck 101. The recording medium P is taken out from the deck 101 by a pickup roller 104 and conveyed by a deck paper feed roller 105. A retard roller 106 pairs with the deck paper feed roller 105 and prevents erroneous multiple sheets conveyance of the recording medium P.

A paper feed sensor 107 provided downstream the deck paper feed roller 105 detects a paper conveyance state from a double-side reversing unit. The recording medium P is conveyed by a pair of registration rollers 109 via a paper conveyance roller 108 in synchronism with the print timing. A pre-registration roller 110 detects the conveyance state of the recording medium P to the pair of registration rollers 109. A process cartridge 112 is provided downstream the pair of registration rollers 109 to form a toner image on a photosensitive drum 1 on the basis of a laser beam from a laser scanner unit 111.

A roller member 113 (to be referred to as a transfer roller hereinafter) transfers the toner image formed on the photosensitive drum 1 to the recording medium P. A discharge member 114 (to be referred to as an antistatic rod hereinafter) removes charges from the recording medium P to prompt separation from the photosensitive drum 1. A fixing apparatus 116 thermally fixes the toner image transferred onto the recording medium P which is conveyed to the downstream of the antistatic rod 114 via a conveyance guide 115. The recording medium P conveyed from the fixing apparatus 116 is conveyed to a paper discharge unit or double-side reversing unit by a double-side flapper 120.

When the recording medium P is conveyed to the paper discharge unit, a fixing discharge sensor 119 detects the conveyance state from the fixing apparatus 116. A discharge sensor 121 detects the paper conveyance state in the paper discharge unit. A pair of discharge rollers 122 discharge the recording medium P. On the other hand, when the recording medium P is conveyed to the double-side reversing unit, the recording medium P with one surface printed is reversed so that both surfaces are printed. The double-side reversing unit feeds the recording medium P to the side of the paper conveyance roller 108 again. A pair of reversing rollers 123 reverse the direction of the recording medium P by switchback. A reversing sensor 124 detects the paper conveyance state to the pair of reversing rollers 123. The recording medium P is conveyed by a D cut roller 125 from a horizontal registration unit (not shown) for aligning the horizontal direction of the recording medium P. A pair of double-side conveyance rollers 127 further convey the recording medium P from the double-side reversing unit to the side of the paper conveyance roller 108. A double-side sensor 126 detects the conveyance state of the recording medium P in the double-side reversing unit.

Figure 2:
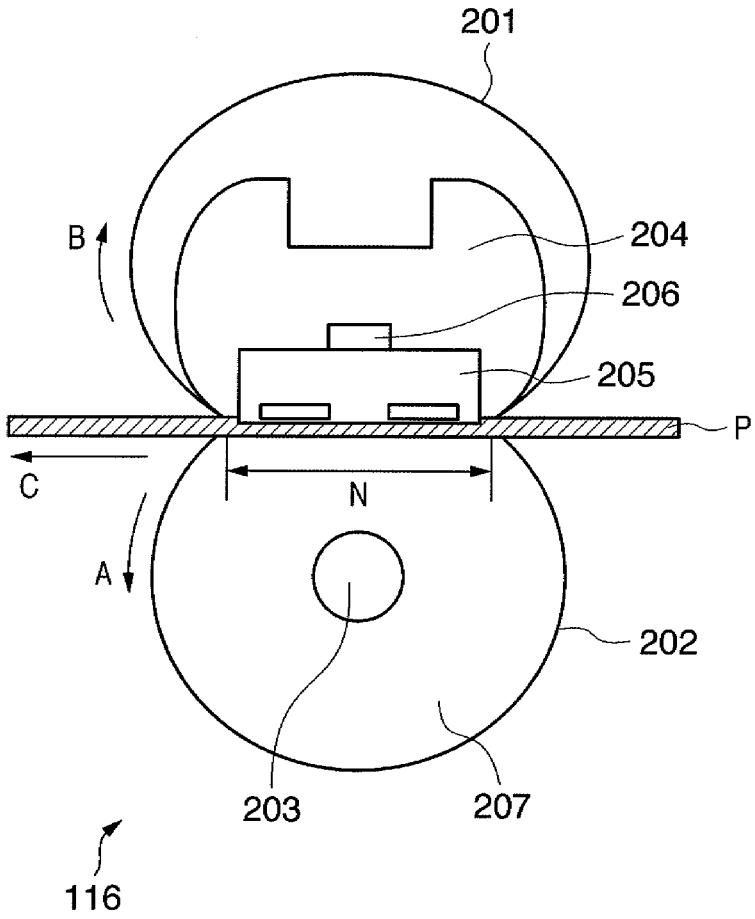
FIG. 2 is a side view of a fixing apparatus shown in FIG. 1.

FIG. 2 is a side view of the fixing apparatus 116 shown in FIG. 1, which includes a pressing member 202 (to be referred to as a pressing roller 202 hereinafter). The fixing apparatus 116 is a general film heat fixing apparatus. The fixing apparatus 116 includes a rotating member 201 (to be referred to as a fixing film 201 hereinafter), rigid stay 204, and e.g., a ceramic heater 205 serving as an electrical heating means, and opposes the pressing roller 202. The fixing film 201 is a cylindrical heat-resisting film material which is loosely fitted on the rigid stay 204 incorporating the ceramic heater 205. As the fixing film 201, for example, a cylindrical single-layer film made of a heat-resisting, releasable, strong, and durable material such as PTFE, PFA, or FEP and having a thickness of about 40 to 100 μm is used. A composite-layer film formed by coating the outer surface of a cylindrical film made of, e.g., polyimide, polyamide, PEEK, PES, or PPS with PTFE, PFA, FEP, or the like may also be used.

The pressing roller 202 is an elastic roller formed by concentrically integrally arranging a heat-resisting elastic layer 207 of, e.g., silicone rubber around a core bar 203. The fixing film 201 is sandwiched between the pressing roller 202 and the ceramic heater 205 so as to contact the pressing roller 202 against its elasticity. An arrow N indicates the range of a fixing nip portion formed by the contact. A fixing driving motor 581 (see FIG. 1) to be described later drives and rotates the pressing roller 202 in the direction of an arrow A at a predetermined speed. When the pressing roller 202 rotates, the rotary power directly acts on the fixing film 201 at the fixing nip portion N due to the frictional force between the pressing roller 202 and the outer surface of the fixing film 201. Consequently, the fixing film 201 rotates in the direction of an arrow B while contacting the lower surface of the ceramic heater 205. When the recording medium P is inserted in the fixing nip portion N in the direction of an arrow C, the rotary power indirectly acts on the fixing film 201 through the recording medium P.

The rigid stay 204 is an oblong member which is elongated in a direction (direction perpendicular to the drawing surface) traversing the conveyance path of the recording medium P and has heat resistance and heat insulating properties. The rigid stay 204 fixes the ceramic heater 205.

The ceramic heater 205 is an oblong member which is elongated in a direction traversing the transfer material conveyance path. The ceramic heater 205 is fitted in a groove formed in the lower surface of the rigid stay 204 along the longitudinal direction and fixed by a heat-resisting adhesive. The ceramic heater 205 has a thermistor 206 (to be described later) on its upper surface.

The rigid stay 204 also functions as an inner surface guide member for the fixing film 201 and facilitates rotation of the fixing film 201. The slide resistance between the inner surface of the fixing film 201 and the lower surface of the ceramic heater 205 may be reduced by applying, between them, a small amount of lubricant such as heat-resistant grease.

When the fixing film 201 steadily rotates as the pressing roller 202 rotates, and the temperature of the ceramic heater 205 reaches a predetermined temperature, the recording medium P bearing an image is introduced between the fixing film 201 and the pressing roller 202 at the fixing nip portion N. Heat from the ceramic heater 205 is supplied to the unfixed image portion on the recording medium P via the fixing film 201. As a result, the unfixed image portion on the recording medium P is heated and fixed on the recording medium P. The recording medium P that has passed through the fixing nip portion N is separated from the surface of the fixing film 201 and conveyed in the direction of the arrow C.

Figure 3:
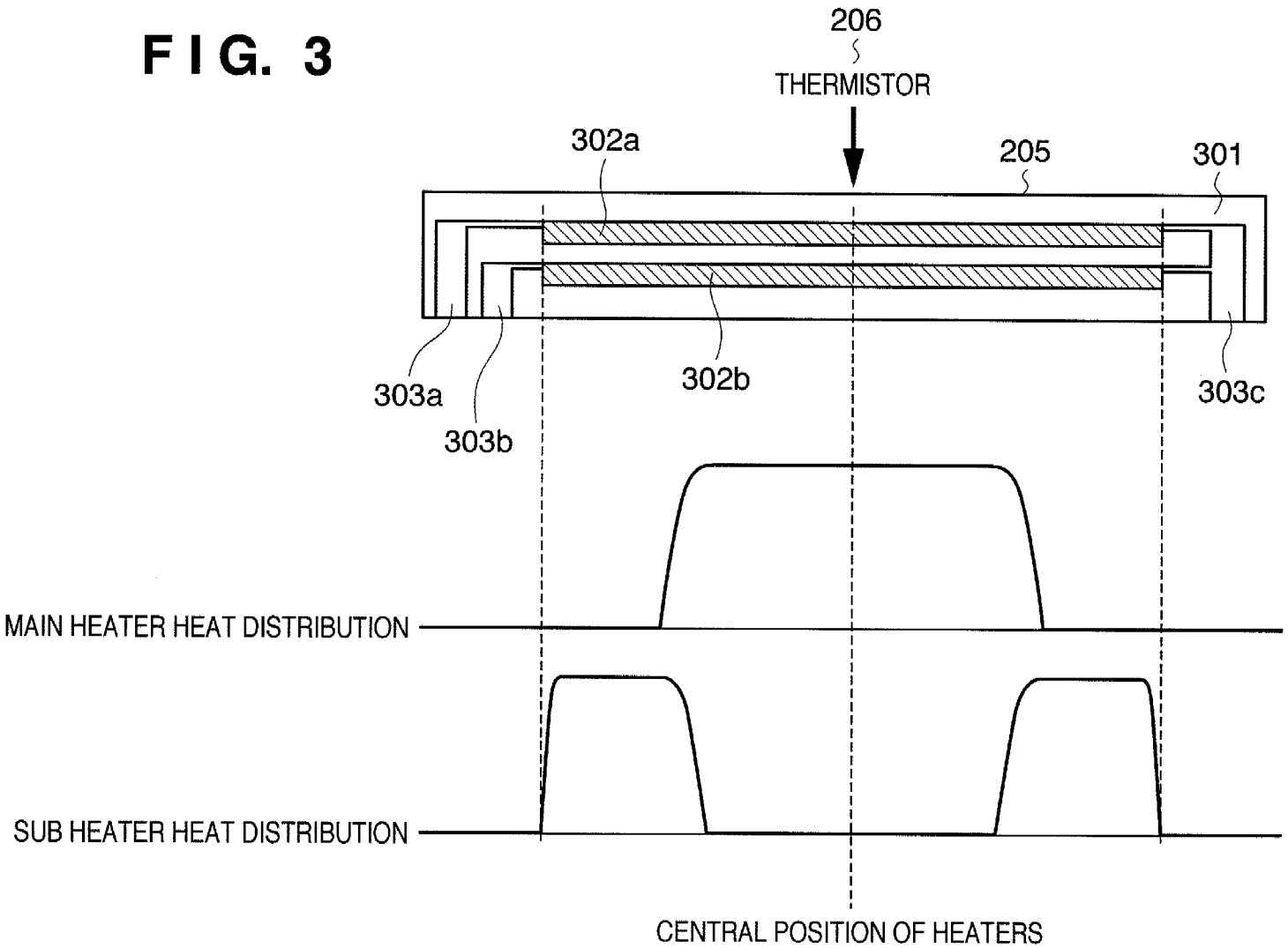
FIG. 3 is a view showing the detailed arrangement of a ceramic heater shown in FIG. 2 and the heat distribution of a main heater and a sub heater.

FIG. 3 is a view showing the detailed arrangement of the ceramic heater shown in FIG. 2 and the heat distribution of a main heater serving as a first heating element and a sub heater serving as a second heating element. FIG. 3 illustrates the ceramic heater 205 viewed from the upper side in FIG. 2.

The ceramic heater 205 is a member elongated in the direction perpendicular to the conveyance direction of the recording medium P. The ceramic heater 205 includes a base member 301 made of, e.g., alumina ($Al_2O_3$), and heating patterns 302*a* and 302*b* serving as heating elements. The heating patterns 302*a* and 302*b* are formed on the side of one surface of the ceramic heater 205 and covered with a glass protective film serving as an electrical insulating layer. A heater unit formed by the heating pattern 302*a* will be referred to as a main heater serving as a first heating element, and a heater unit formed by the heating pattern 302*b* will be referred to as a sub heater serving as a second heating element hereinafter. Electrode 303*a*, 303*b*, and 303*c* are feeder electrodes which apply a voltage across the main heater 302*a* and sub heater 302*b*.

As shown in FIG. 3, the main heater 302*a* and sub heater 302*b* have different heat distributions. As indicated by the main heater heat distribution in FIG. 3, the heat distribution of the main heater 302*a* exhibits a large heat amount near the center of the ceramic heater 205 in its longitudinal direction. As indicated by the sub heater heat distribution in FIG. 3, the heat distribution of the sub heater 302*b* exhibits a large heat amount at the ends of the ceramic heater 205 in its longitudinal direction.

The fixing apparatus 116 according to this embodiment has, e.g., the thermistor 206 serving as a temperature detection means for measuring the temperature of the ceramic heater 205, and a thermal switch serving as a safety element to be actuated in case of an abnormal temperature rise.

Figure 5:
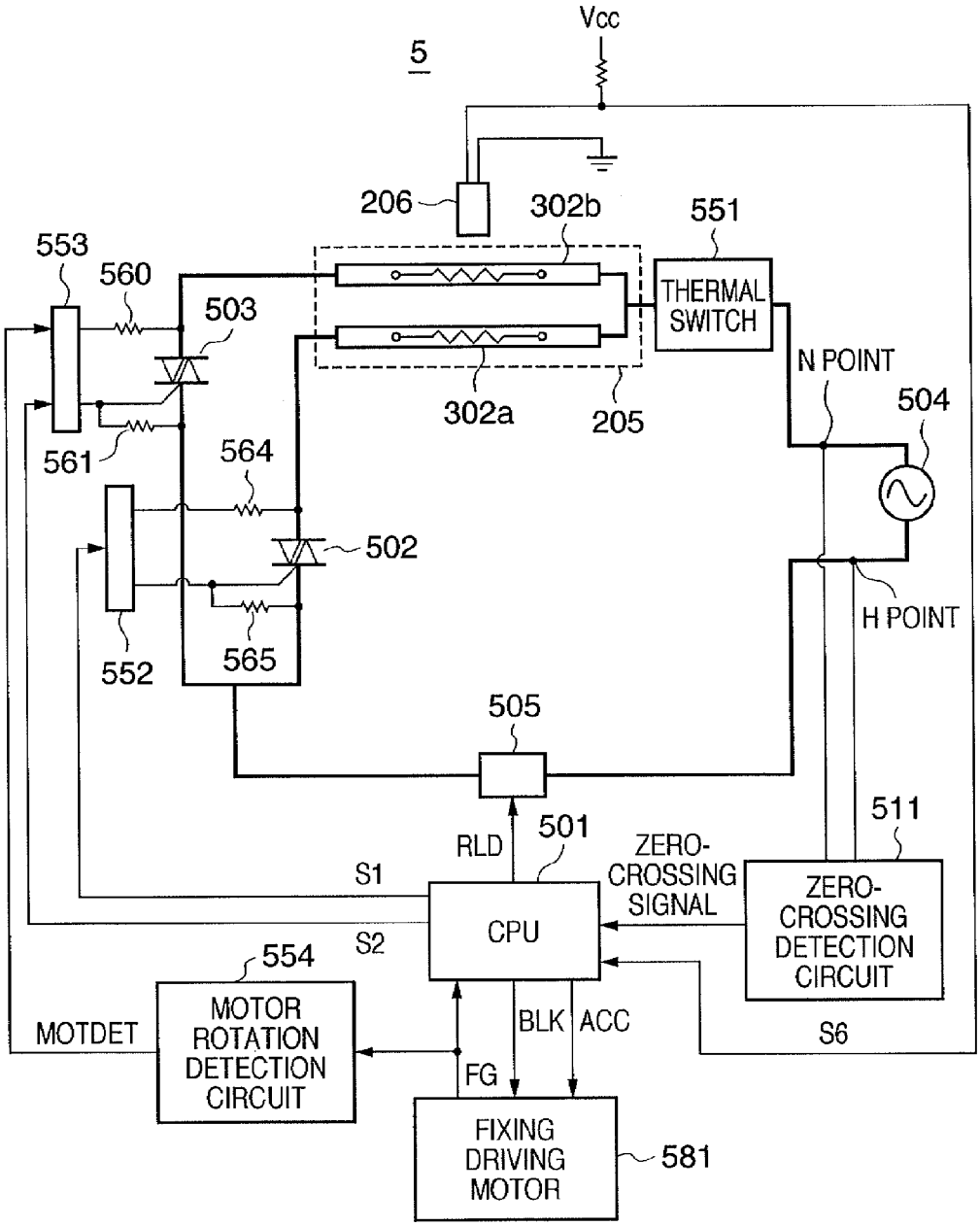
FIG. 5 is a block diagram showing the arrangement of the power supply control circuit of a fixing apparatus according to the first embodiment of the present invention.

As shown in FIG. 3, the thermistor 206 is arranged at the center of the ceramic heater 205 in its longitudinal direction and pressed against the upper surface of the ceramic heater 205 at a predetermined pressure. As shown in FIG. 5, one terminal of the thermistor 206 receives a power supply voltage Vcc via a resistor 604, while its other terminal is grounded. The resistance value of the thermistor 206 changes in accordance with the temperature. The change is output to a CPU 501 serving as a control unit as a detection signal S6. As shown in FIG. 5, the thermal switch is connected between an AC power supply 504 and the main heater 302*a* and sub heater 302*b* and cuts the energization path at the actuation temperature. In this embodiment, the thermal switch is actuated at 250° C. That is, the safety element is connected in series with a power supply line connecting the heating elements (302*a* and 302*b*) to AC power supply, and de-energizes the heating elements (302*a* and 302*b*) upon detecting an abnormal temperature rise in the heating elements (302*a* and 302*b*).

The actuation temperature of the thermal switch will now be described below.

Figure 4:
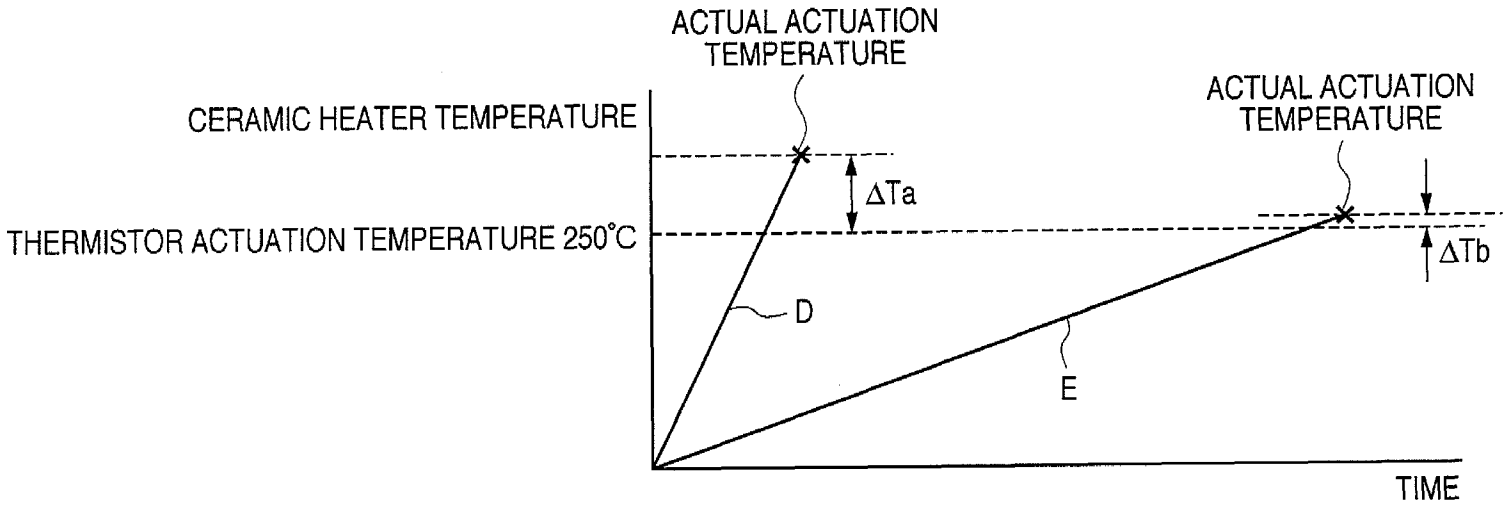
FIG. 4 is a graph showing the relationship between the temperature of the ceramic heater and the actuation temperature of a thermal switch.

FIG. 4 is a graph showing the relationship between the temperature of the ceramic heater and the actuation temperature of the thermal switch. As a characteristic feature, the actual actuation temperature of the thermal switch generally changes in accordance with the rise rate of the ambient temperature due to its heat capacity. A line D indicates the actual actuation temperature of the thermal switch when the temperature of the ceramic heater 205 changes steeply. In the line D, the thermal switch is actually actuated at a temperature higher than 250° C. by ΔTa to cut the energization path. On the other hand, a line E indicates the actual actuation temperature of the thermal switch when the temperature of the ceramic heater 205 changes moderately. In the line E, the thermal switch is actually actuated at a temperature higher than 250° C. by ΔTb to cut the energization path. As shown in FIG. 4, ΔTa is larger than ΔTb. As the temperature of the ceramic heater 205 rises to the actuation temperature more moderately, the thermal switch is actuated at a temperature (actuation temperature) closer to 250° C.

The power supply control circuit of the fixing apparatus, which supplies a current to the ceramic heater 205, will be described next. FIG. 5 is a block diagram showing an example arrangement of the power supply control circuit according to the first embodiment of the present invention. As shown in FIG. 5, a power supply control circuit 5 includes the ceramic heater 205, a thermal switch 551, the CPU 501 serving as a control unit, first and second triacs 502 and 503, the AC power supply 504, and a relay circuit 505. The power supply control circuit 5 also includes a zero-crossing detection circuit 511, first and second triac driving circuits 552 and 553, a motor rotation detection circuit 554 serving as a rotation detection circuit, and the fixing driving motor 581. The first triac 502 and the main heater 302*a* are connected in series. The second triac 503 and the sub heater 302*b* are connected in series. The series circuit of the first triac 502 and the main heater 302*a* and that of the second triac 503 and the sub heater 302*b* are connected in parallel with respect to the AC power supply.

As shown in FIG. 5, the relay circuit 505 is connected between the AC power supply 504 and one terminal of each of the first and second triacs 502 and 503. The relay circuit 505 is controlled by a signal RLD from the CPU 501 to cut the energization path. The thermal switch 551 is connected between the AC power supply 504 and one terminal of each of the main heater 302*a* and sub heater 302*b*. The thermal switch 551 cuts the energization path when the temperature of the ceramic heater 205 has reached the actuation temperature.

The first triac driving circuit 552 (to also be referred to as a driving circuit 552 hereinafter) is connected to the first triac 502 via resistors 564 and 565 and controlled by a driving signal S1 supplied from the CPU 501 to turn on/off the first triac 502. The driving circuit 552 can switch the power supply line from the power supply to the first heating element 302*a* between the ON state and the OFF state by turning on/off the first triac 502. The second triac driving circuit 553 (to also be referred to as a driving circuit 553 hereinafter) is connected to the second triac 503 via resistors 560 and 561 and controlled by a driving signal S2 supplied from the CPU 501 to turn on/off the second triac 503. The driving circuit 553 can switch the power supply line from the power supply to the second heating element 302*b* between the ON state and the OFF state by turning on/off the second triac 503.

The zero-crossing detection circuit 511 detects the phase of the power supply voltage of the AC power supply 504 at the N (Neutral) and H (Hot) points shown in FIG. 5 and outputs, to the CPU 501, a pulse signal (to be referred to as a zero-crossing signal hereinafter) that changes depending on the phase. The thermistor 206 detects the temperature of the ceramic heater 205 and outputs the detection signal S6 to the CPU 501, as already described above. The motor rotation detection circuit 554 and fixing driving motor 581 will be described later. With the above arrangement, the power supply control circuit 5 executes full-wave phase control of the power to be supplied to the ceramic heater 205.

In this embodiment, the power supply control circuit 5 executes full-wave phase control of the AC current to be supplied to the first and second triacs 502 and 503, thereby controlling the power to be supplied to the ceramic heater 205. The full-wave phase control method is known as a method of controlling the phase by changing the time from the zero-crossing point in an AC waveform to the energization timing. In this embodiment, the CPU 501 outputs the driving signal S1 on the basis of, e.g., a zero-crossing signal to apply desired power to the main heater 302*a*.

Figure 6A:
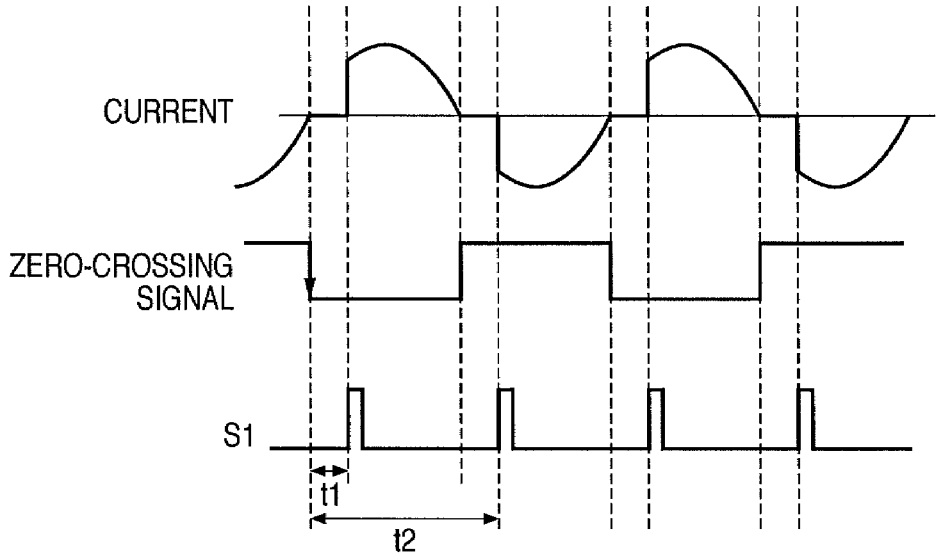
FIG. 6A is a timing chart showing the timings of a zero-crossing signal and a driving signal S1.

FIG. 6A is a timing chart showing the timings of the zero-crossing signal and the driving signal S1. As shown in FIG. 6A, the CPU 501 outputs the driving signal S1 of high level at timings delayed by predetermined times t1 and t2 from the trailing edge of the zero-crossing signal indicated by an arrow in one period of an AC current waveform supplied from the AC power supply 504 to the first triac 502.

When the driving signal S1 goes high, a current flows to the first triac 502. Although the driving signal S1 output from the CPU 501 goes low again, the ON state of the first triac 502 is maintained up to the zero-crossing point of the AC waveform of the AC power supply.

FIG. 6B is a table showing the relationship between the times t1 and t2 and the power applied to the ceramic heater 205. In this embodiment, it is possible to apply desired power to the ceramic heater 205 by setting the timings (times t1 and t2) of turning on of the driving signal S1 in accordance with the table shown in FIG. 6B. In the table shown in FIG. 6B, the frequency of the AC power supply is 50 Hz. When energization is done in all phases, the applied power is 100%.

Figure 7:
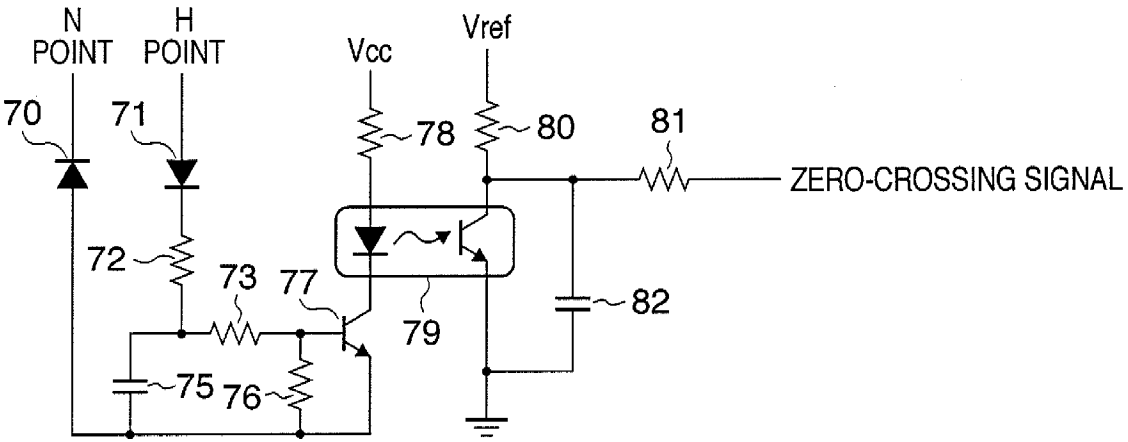
FIG. 7 is a circuit diagram showing the internal arrangement of a zero-crossing detection circuit.

FIG. 7 is a circuit diagram showing the internal arrangement of the zero-crossing detection circuit. Rectification diodes 70 and 71 half-wave-rectify AC voltages supplied from the N and H points, respectively. A current defined by current limiting resistors 72, 73, and 76 is supplied to the base of a transistor 77. A capacitor 75 is inserted to remove external noise. In FIG. 7, a photocoupler 79 is used to ensure the creepage distance between the primary side and the secondary side. The primary-side power supply voltage Vcc is applied to the light-emitting side of the photocoupler 79 via a current limiting resistor 78. A secondary-side power supply voltage Vref is applied to the collector of the output transistor of the photocoupler 79 via a current limiting resistor 80. The output from the photocoupler 79 is supplied to the CPU 501 as a zero-crossing signal via a capacitor 82 and a resistor 81.

Referring to FIG. 7, when the H-point voltage is higher than the threshold voltage of the transistor 77, the transistor 77 and photocoupler 79 are turned on, and the zero-crossing signal goes low. When the H-point voltage is lower than the threshold voltage, the transistor 77 and photocoupler 79 are turned off, and the zero-crossing signal goes high. Hence, the zero-crossing signal serves as a pulse signal to output high level or low level.

Figure 8A:
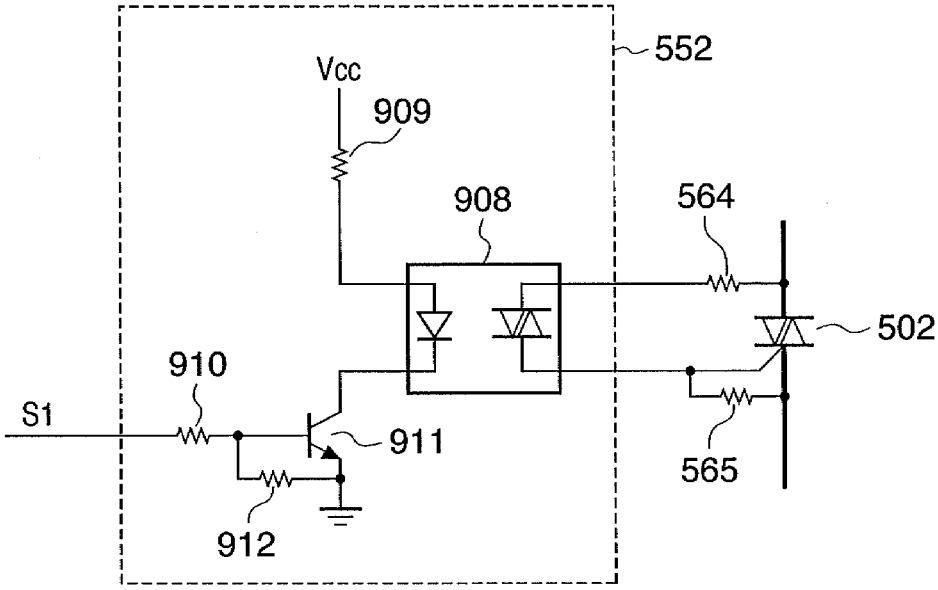
FIG. 8A is a circuit diagram showing the internal arrangement of a first triac driving circuit.

FIG. 8A is a circuit diagram showing the internal arrangement of the first triac driving circuit 552 for driving the first triac 502. When the CPU 501 outputs the driving signal S1 of high level, a transistor 911 is turned on to flow a current from the power supply voltage Vcc to the photodiode of a phototriac 908 via a resistor 909. Reference number 910 and 912 are resistors As a consequence, a current flows to the gate of the triac 502 via the resistors 564 and 565 to turn it on. The current flowing to the triac 502 changes in the same manner as in FIG. 6 in accordance with the zero-crossing signal and the driving signal S1.

Figure 8B:
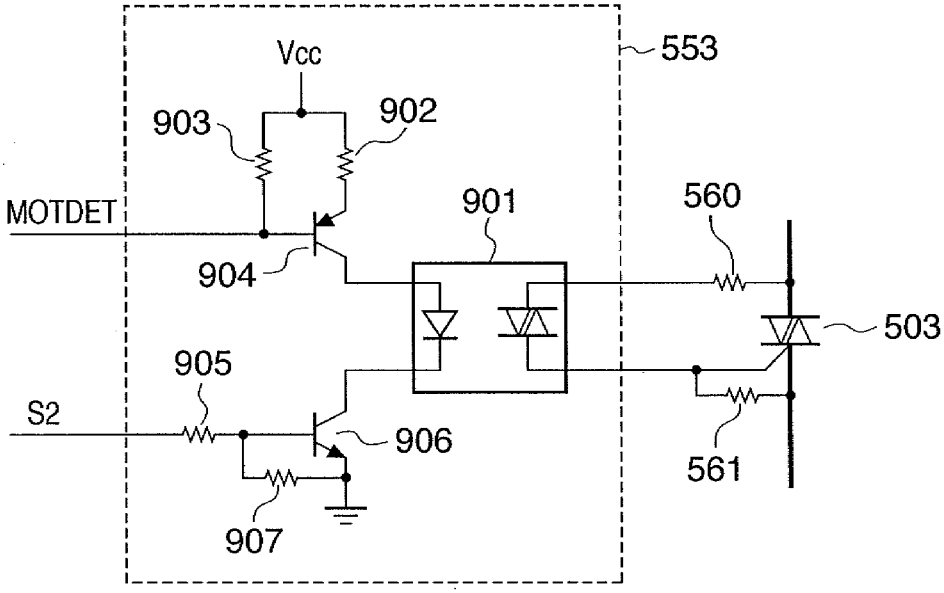
FIG. 8B is a circuit diagram showing the internal arrangement of a second triac driving circuit.

FIG. 8B is a circuit diagram showing the internal arrangement of the second triac driving circuit 553 for driving the second triac 503. FIG. 8B is different from FIG. 8A in that the driving circuit includes a limiting circuit (in this embodiment, a transistor 904 and resistors 902 and 903). The transistor (switching element) 904 is controlled by a driving signal MOTDET input from the motor rotation detection circuit 554. The switching element is not limited to the transistor 904 and can be any other device ON/OFF-controlled by a signal. When the signal MOTDET goes low, the transistor 904 is turned on so that the driving signal S2 from the CPU 501 serving as a control unit controls a phototriac 901. When the signal MOTDET goes high, the transistor 904 is turned off so no voltage is applied to the photodiode of the phototriac 901 regardless of whether a transistor 906 is turned on or off. Reference number 905 and 907 are resistors As a result, the phototriac 901 is turned off independently of the driving signal S2 from the CPU 501 serving as a control unit. This forcibly turns off the second triac 503, i.e., switches the second triac to the OFF state. More specifically, when the motor rotation detection circuit 554 detects that the rotating member 201 or pressing member 202 is not rotating, the limiting circuit limits the driving of the driving circuit 553 in accordance with the output from the motor rotation detection circuit 554 to de-energize the heating element 302*b* regardless of the driving signal S2 from the control unit 501 to the driving circuits 553.

Figure 9:
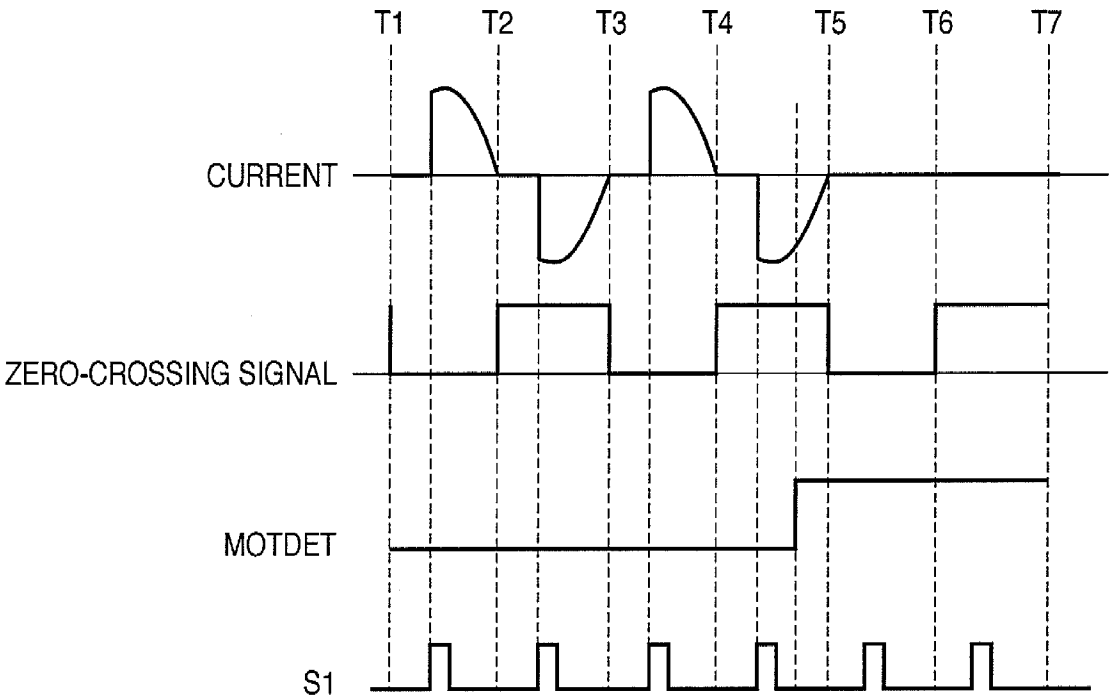
FIG. 9 is a timing chart showing a current flowing to a second triac, a zero-crossing signal, and driving signals MOT-DET and S1.

FIG. 9 is a timing chart showing a current flowing to the second triac 503, a zero-crossing signal, and the driving signals MOTDET and S1. At timings T1 to T4, the driving signal MOTDET is at low level. Hence, the phase of the current to be supplied to the heating element 302*b* is controlled in accordance with the driving signal S1. From a timing T5, however, the driving signal MOTDET is at high level. For this reason, the energization path is cut regardless of the driving signal S1 so no current is supplied to the heating element 302*b*.

Referring back to FIG. 5, the fixing driving motor 581 shown in FIG. 5 drives and rotates the pressing roller 202 shown in FIG. 2. As shown in FIG. 5, the fixing driving motor 581 receives signals ACC and BLK from the CPU 501 and outputs a signal FG to the CPU 501 and motor rotation detection circuit 554. When the CPU 501 activates the signal ACC to, e.g., low level, the fixing driving motor 581 is accelerated. When the CPU 501 activates the signal BLK to, e.g., low level, the fixing driving motor 581 is decelerated. The signal FG is output as a pulse signal having a frequency proportional to the rotational speed pf the fixing driving motor 581. Upon receiving the signal FG, the CPU 501 activates or deactivates the signal ACC or BLK to make the signal FG have a frequency of a predetermined value. As a result, the fixing driving motor 581 is controlled to rotate at a constant speed. The motor rotation detection circuit 554 shown in FIG. 5 has a rotation detection means for receiving the signal FG from the fixing driving motor 581 and detecting the rotation state of the motor.

In this embodiment, the rotation state of the pressing roller or fixing film is detected on the basis of the rotation state of the motor. However, the rotation state of the pressing roller or fixing film may directly be detected.

Figure 10:
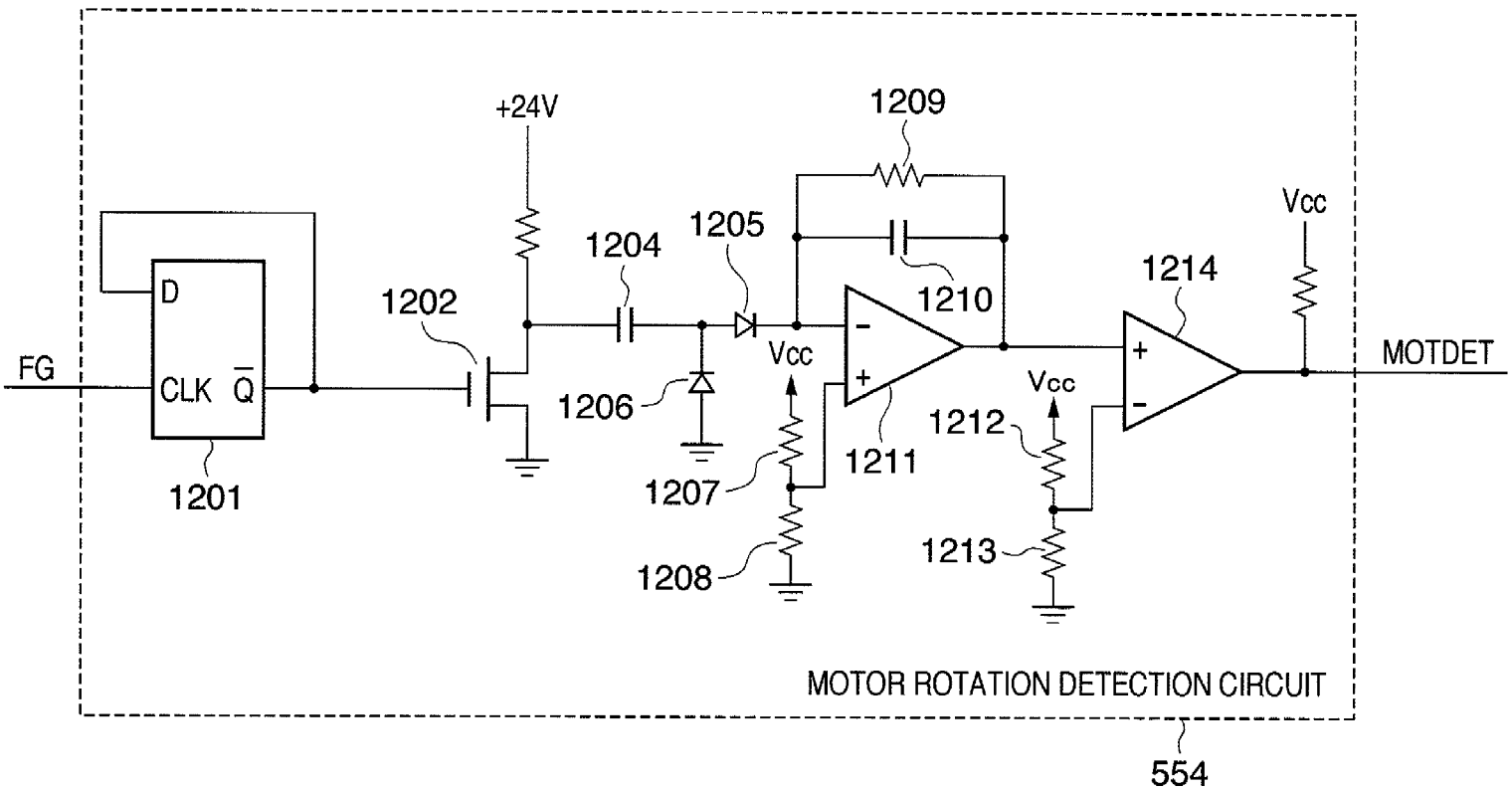
FIG. 10 is a circuit diagram showing the internal arrangement of a motor rotation detection circuit.

FIG. 10 is a circuit diagram showing the internal arrangement of the motor rotation detection circuit 554. As shown in FIG. 10, a D flip flop 1201 halves the frequency of the signal FG input from the fixing driving motor 581 and supplies it to the gate of a transistor 1202. The transistor 1202 applies a square wave to a capacitor 1204 by a switching operation. In this embodiment, the square wave has an amplitude of 24 V. The square wave is further supplied to the inverting input terminal of an operational amplifier 1211 via diodes 1205 and 1206. The operational amplifier 1211, resistor 1209, and capacitor 1210 constitute an integrating circuit so that the supplied square wave is converted into a DC signal and output from the operational amplifier 1211. The voltage is divided by resistors 1207 and 1208, and the divided voltage is supplied to the input terminal of an operational amplifier 1211.

An output voltage Vop of the operational amplifier 1211 is given by $$Vop=Vt-(24-Vt)\times C1204\times R1209\times f\div 2 \quad (1)$$

where Vt is the noninverting input terminal voltage of the operational amplifier 1211, C1204 is the electrostatic capacitance of the capacitor 1204, R1209 is the resistance value of the resistor 1209, and f is the frequency of the signal FG. As indicated by Equation (1), the output voltage Vop depends on the frequency of the signal FG. The higher the frequency of the signal FG is, the lower the output voltage Vop is. The output voltage Vop of the operational amplifier 1211 is input to the noninverting input terminal of a comparator 1214.

The comparator 1214 compares the output voltage Vop with a reference voltage decided by resistors 1212 and 1213. Hence, the level of the signal MOTDET output from the comparator 1214 is determined on the basis of the frequency of the signal FG. In this embodiment, when the fixing driving motor 581 is rotating, the output from the comparator 1214 goes low. If the fixing driving motor 581 stops rotating, the output from the comparator 1214 goes high.

The operation of the power supply control circuit 5 will be described next with reference to FIG. 5. The power supply control circuit 5 has a print operation mode in which the image forming apparatus including the power supply control circuit 5 is powered on, and a print operation is executed, and a standby mode in which the print operation is not executed.

In the print operation mode, the fixing driving motor 581 is rotated to supply a current to the main heater 302*a* and sub heater 302*b*. Consequently, both the main heater 302*a* and sub heater 302*b* generate heat. In the print operation mode, the CPU 501 receives, e.g., a print start signal from an external controller (not shown) and executes an image forming sequence program. At this time, the CPU 501 turns on the first and second triacs (502 and 503), i.e., switches the triacs to the ON state by the driving signals S1 and S2. As a result, a current is supplied to the main heater 302*a* and sub heater 302*b*.

In this embodiment, the current to be supplied to the sub heater 302*b* is controlled in accordance with the lateral dimension of the recording medium P so that power having a predetermined ratio to the main heater 302*a* is supplied to the sub heater 302*b*. The lateral dimension of the recording medium P indicates the width of the recording medium P in a direction perpendicular to the conveyance direction.

Figure 11A:
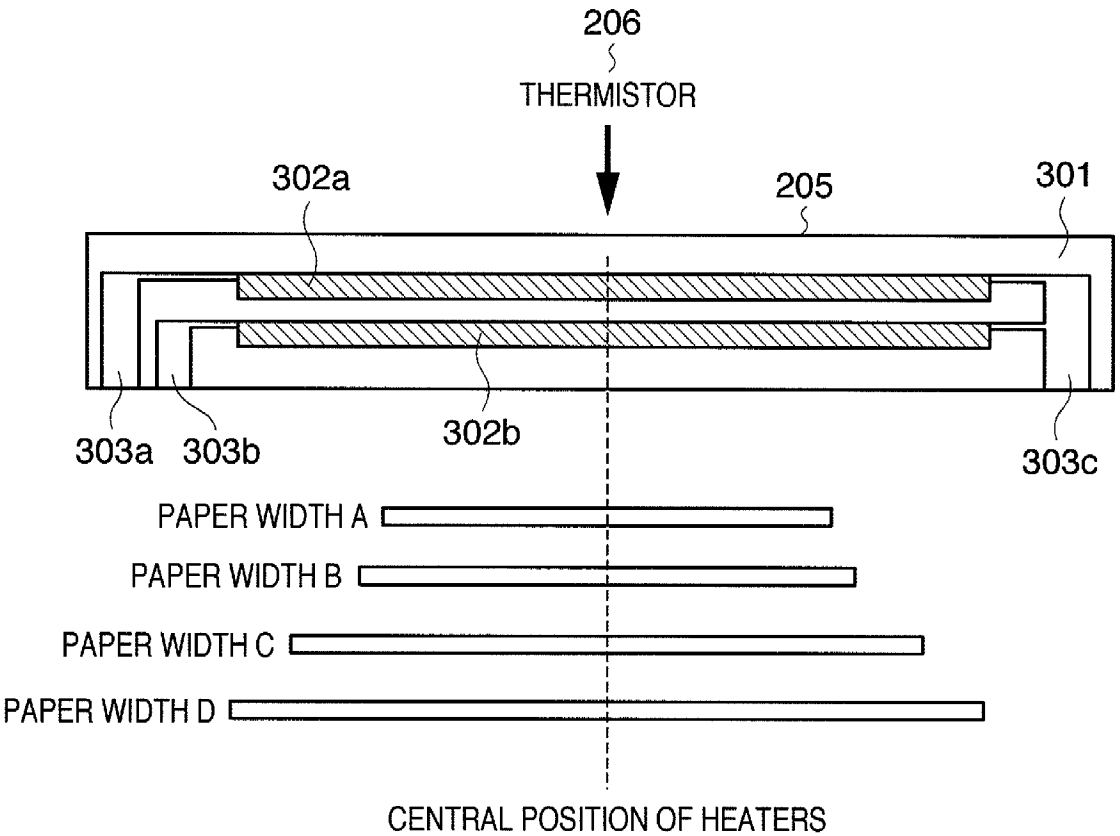

FIGS. 11A and 11B are views showing the relationship between the recording medium lateral dimensions and the energization settings of the sub heater 302*b*. As shown in FIGS. 11A and 11B, the power ratio of the sub heater 302*b* to the main heater 302*a* is set for each of four lateral dimensions. More specifically, as the lateral dimension decreases, the power ratio of the sub heater 302*b* to the main heater 302*a* is set to be lower. This prevents the temperature at an end of the fixing apparatus 116 from rising during the print operation (this phenomenon will be referred to as an end temperature rise hereinafter). If the lateral dimension of the recording medium P is smaller than the width of the heating area of the fixing apparatus 116, a non-paper passage area exists at each end of the fixing apparatus 116. Since the amount of deprived heat is largely different between the portion where the recording medium P passes and those where the recording medium P does not pass, the temperature at the ends of the ceramic heater 205 rises. This end temperature rise poses various problems such as wrinkles of the recording medium and a toner offset on the fixing film. The nonuniformity of the temperature of the ceramic heater 205 increases as the lateral dimension of the recording medium P passed becomes smaller. In this embodiment, however, the power supply to the sub heater 302*b* is set as shown in FIGS. 11A and 11B, thereby avoiding the above-described problems.

As already described above, the thermistor 206 detects the temperature of the ceramic heater 205. The thermistor 206 located at the central position of the ceramic heater 205 in its longitudinal direction can detect the temperature state at the center of the ceramic heater 205. The CPU 501 detects the difference between the temperature detected by the thermistor 206 and the target temperature serving as the reference and controls the first and second driving circuits to keep the center of the ceramic heater 205 at a set temperature. More specifically, the CPU 501 controls the driving circuits to cause the heating elements 302*a* and 302*b* to maintain the set temperature. The power supply control circuit 5 of this embodiment operates such that the thermistor detects a predetermined temperature of 200° C. in the print operation mode.

The standby mode will be described next. In the standby mode, the fixing driving motor 581 is at rest, and the power is supplied to only the main heater 302*a*. That is, the power supply control circuit 5 partially limits the power to be supplied to the ceramic heater 205 in the standby mode. The power to be supplied to the main heater 302*a* is controlled on the basis of the temperature detected by the thermistor 206. The power supply control circuit 5 of this embodiment operates such that the thermistor detects a predetermined temperature of 80° C. in the standby mode.

As described above, even in the standby mode, control is executed to keep a predetermined detection temperature of the thermistor. This shortens the rise time of the ceramic heater 205 to the print operation mode. In the print operation mode, the pressing roller 202 is driven, and therefore, the amount of heat dissipated from the ceramic heater 205 to the pressing roller 202 is larger than in the standby mode with the pressing roller 202 at rest. Hence, in the print operation mode, large power is necessary for controlling the ceramic heater 205 to a desired temperature. Conversely, in the standby mode, the power is necessary for controlling the ceramic heater 205 to a desired temperature can be small.

An operation of a safety element that suppresses overheat of the ceramic heater 205 in the event of energization runaway will be described next. Energization runaway indicates a state in which the first triac 502 and/or second triac 503 is fixed in the ON state due to some reason to continuously supply a current to the ceramic heater 205. Such energization runaway can occur because, for example, software implemented in the CPU 501 runs way out of control so that a current is continuously supplied to the ceramic heater 205.

Anyway, when energization runaway occurs in one of the main heater 302*a* and the sub heater 302*b*, the temperature of the ceramic heater 205 does not steeply rise. Hence, the thermal switch can be actuated near 250° C. shown in FIG. 4. It is therefore possible to prevent damage such as deformation or deterioration in the vicinity of the fixing apparatus 116 due to overheat of the ceramic heater 205.

Consider a case in which energization runaway occurs in both of the main heater 302*a* and sub heater 302*b*. If this occurs in the print operation mode, the temperature of the ceramic heater 205 rises. However, as already described, the heat generated by the ceramic heater 205 is dissipated to the rotating pressing roller 202. Therefore, the temperature of the ceramic heater 205 moderately rises. It is therefore possible to prevent damage such as deformation or deterioration in the vicinity of the fixing apparatus 116 due to overheat of the ceramic heater 205.

Figure 12:
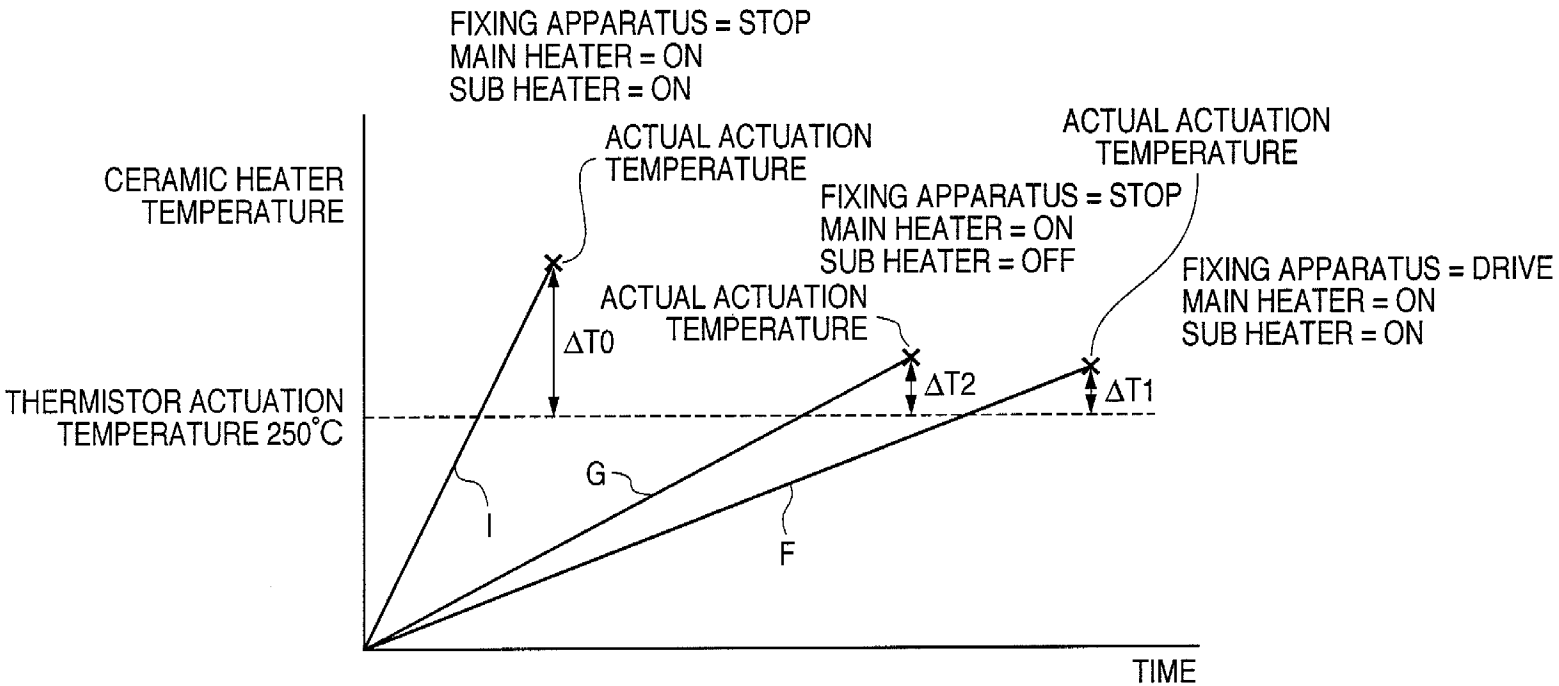
FIG. 12 is a graph showing a time-rate change in the temperature of the ceramic heater in energization runaway.

FIG. 12 is a graph showing a time-rate change in the temperature of the ceramic heater in the event of energization runaway. A line F in FIG. 12 indicates the print operation mode. In the standby mode, the pressing roller 202 is at rest. In this embodiment, the driving signal MOTDET output from the motor rotation detection circuit 554 forcibly turns off the second triac 503, i.e., switches the triac to the OFF state. Hence, in the standby mode, energization runaway never occurs in both the main heater 302*a* and sub heater 302*b*. The temperature of the ceramic heater 205 rises as indicated by a line G in FIG. 12. More specifically, since the pressing roller 202 is at rest, the heat from the ceramic heater 205 is hardly dissipated. However, since the second triac 503 is OFF, the actual actuation temperature of the thermal switch is only slightly higher than in the line F. It is therefore possible to prevent damage such as deformation or deterioration in the vicinity of the fixing apparatus 116 due to overheat of the ceramic heater 205.

A line I shown in FIG. 12 indicates a temperature rise when energization runaway occurs in both the main heater 302*a* and sub heater 302*b* in the standby mode. In this case, the temperature steeply rises, and the actual actuation temperature of the thermal switch is higher than in the lines F and G. This increases the risk of causing damage such as deformation or deterioration in the vicinity of the fixing apparatus 116. In the standby mode with the pressing roller 202 at rest, the fixing apparatus 116 of this embodiment forcibly turns off the second triac 503, i.e., switches the triac to the OFF state in accordance with the driving signal MOTDET output from the motor rotation detection circuit 554, as described above. Hence, even when energization runaway has occurred in the standby mode, the rate of temperature rise in the ceramic heater 205 can be suppressed, and the thermal switch can be actuated at a low temperature. It is therefore possible to reduce the risk of causing damage such as deformation or deterioration in the vicinity of the fixing apparatus due to energization runaway.

In an image forming apparatus which includes the above-described fixing apparatus 116 and transfers a toner image formed on an image carrier onto a recording medium by electrophotography, a fixing apparatus capable of actuating a safety element before the apparatus suffers thermal damage can be provided. In this embodiment, the first triac 502 can be energized independently of the mode. It is therefore possible to control the temperature of the ceramic heater 205 even in the standby mode and shorten the rise time to the print operation mode. In the above-described embodiment, one sub heater 302*b* serving as the second heating element is used. However, the fixing apparatus may include two or more sub heaters 302*b*, each serving as the second heating element (of N (N is an integer) heating elements, (N−1) heating elements serve as the second heating elements). In this case, only the main heater 302*a* serving as the first heating element is energized, and the two or more (N−1) sub heaters serving as the second heating elements are forcibly turned off, i.e., switched to the OFF state by the driving signal MOTDET output from the motor rotation detection circuit 554.

More specifically, when the rotation detection circuit 554 detects that the rotating member 201 or pressing member 202 is not rotating, one to (N−1) limiting circuits limit the driving of one to (N−1) driving circuits 553 in accordance with the output from the rotation detection circuit 554 to suppress energization of the heating elements 302*b* regardless of the driving signal S2 from the control unit 501 to the driving circuit 553.

More specifically, each of one to (N−1) limiting circuits has the switching element 904 which switches the driving circuit 553 between the ON state and the OFF state in accordance with the output from the rotation detection circuit 554. When the rotation detection circuit 554 detects that the rotating member 201 or pressing member 202 is not rotating, one to (N−1) switching elements 904 set the driving circuit in the OFF state.

Second Exemplary Embodiment

A second exemplary embodiment of the present invention will now be described next. In the second embodiment, in a standby mode in which a pressing roller 202 is at rest, the current to be supplied to both a main heater 302*a* serving as a first heating element and a sub heater 302*b* serving as a second heating element is periodically turned off. The same effect as in this embodiment can be obtained even when the heating element includes only the main heater serving as the first heating element (without the sub heater).

Figure 13:
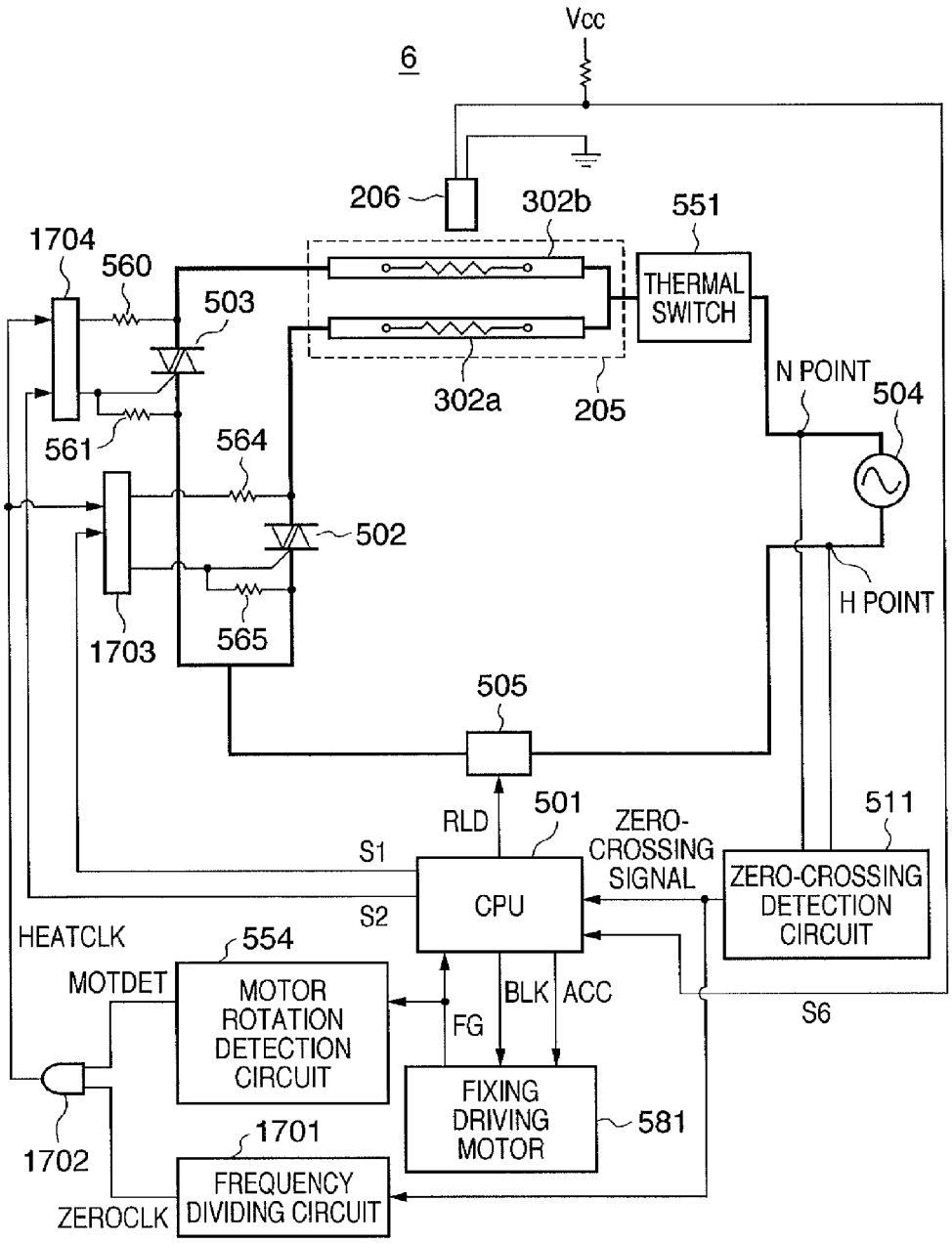
FIG. 13 is a block diagram showing the arrangement of the power supply control circuit of a fixing apparatus according to a second exemplary embodiment of the present invention.

FIG. 13 is a block diagram showing the arrangement of the power supply control circuit of a fixing apparatus 116 according to the second embodiment of the present invention. As shown in FIG. 13, a power supply control circuit 6 is different from the power supply control circuit 5 in that a frequency dividing circuit 1701 and an AND circuit 1702 are added. The frequency dividing circuit 1701 receives a zero-crossing signal and outputs a signal ZEROCLK. The AND circuit 1702 outputs the AND of a signal MOTDET and the signal ZEROCLK to first and second triac driving circuits 1703 and 1704 as a signal HEATCLK.

Figure 14A:
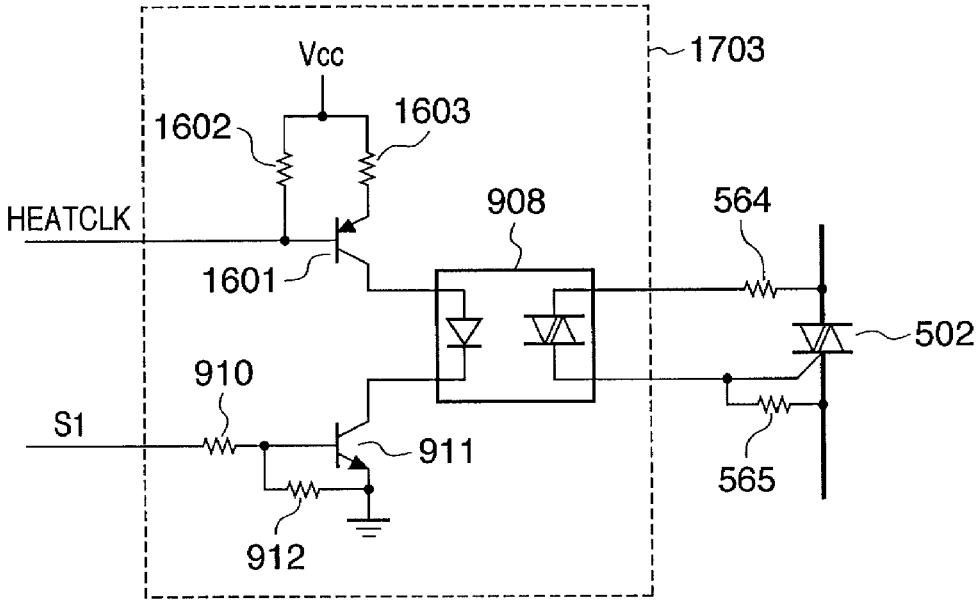
FIG. 14A is a circuit diagram showing the internal arrangement of a first triac driving circuit according to the second embodiment.

FIG. 14A is a circuit diagram showing the internal arrangement of the first triac driving circuit 1703 according to this embodiment. FIG. 14A is different from FIG. 8A in that a limiting circuit (in this embodiment, a transistor 1601 and resistors 1602 and 1603) is added. The transistor (switching element) 1601 is driven by the signal HEATCLK. The switching element is not limited to the transistor 1601 and can be any other device ON/OFF-controlled by a signal. When the signal HEATCLK goes low, the transistor 1601 is turned on so that a driving signal S1 controls a phototriac 908. When the signal HEATCLK goes high, the transistor 1601 is turned off so no voltage is applied to the photodiode of the phototriac 908. As a result, the phototriac 908 is turned off independently of the driving signal S1. This forcibly turns off a first triac 502, i.e., switches the first triac 502 to the OFF state.

Figure 14B:
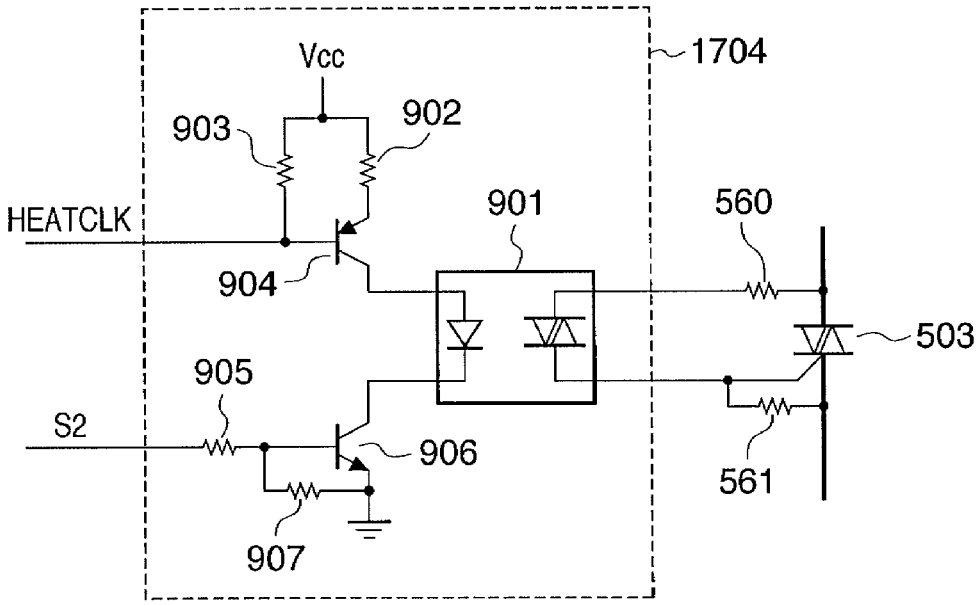
FIG. 14B is a circuit diagram showing the internal arrangement of a second triac driving circuit according to the second embodiment.

FIG. 14B is a circuit diagram showing the internal arrangement of the second triac driving circuit 1704 according to this embodiment. FIG. 14B is different from FIG. 8B in that the signal HEATCLK is input to a transistor 904. Hence, when the signal HEATCLK goes high, a phototriac 901 is turned off independently of a driving signal S2. This forcibly turns off a second triac 503, i.e., switches the second triac to the OFF state. The frequency dividing circuit 1701 shown in FIG. 13 receives a zero-crossing signal from a zero-crossing detection circuit 511, halves the frequency of the signal, and outputs the signal to the AND circuit 1702 as the signal ZEROCLK.

More specifically, when a rotation detection circuit 554 detects that a rotating member 201 or pressing member 202 is not rotating, the limiting circuit limits the driving of the triac driving circuits 1703 and 1704 in accordance with the output from the rotation detection circuit 554 to suppress energization of the heating elements 302*a* and 302*b* regardless of the driving signals S1 and S2 from a control unit 501 to the triac driving circuits 1703 and 1704.

More specifically, the limiting circuit has the switching elements 1601 and 904 which periodically switch the driving circuits between the ON state and the OFF state in accordance with the output from the rotation detection circuit. When the rotation detection circuit 554 detects that the rotating member 201 or pressing member 202 is not rotating, the switching elements 1601 and 904 periodically set the triac driving circuits 1703 and 1704 in the OFF state.

The operation of the power supply control circuit 6 according to this embodiment will be described next with reference to FIG. 13. The power supply control circuit 6 has a print operation mode and a standby mode, like the power supply control circuit 5. The operation of the power supply control circuit 6 in the print operation mode is the same as in the first embodiment.

In the standby mode, a current is supplied to both the main heater 302*a* and sub heater 302*b*, unlike the first embodiment. The phase of the current to be supplied to both heaters is controlled in the same phase. As in the first embodiment, a thermistor 206 detects the temperature of a ceramic heater 205. The CPU 501 controls the ceramic heater 205 to a desired temperature. In this embodiment, control is done to make the thermistor detect a temperature of 80° C.

An operation of a safety element that suppresses overheat of the ceramic heater 205 in energization runaway will be described next. Even in this embodiment, energization runaway can occur because of software in the CPU 501. A case in which energization runaway occurs in the main heater 302*a* and sub heater 302*b* due to such a factor will be described below.

When energization runaway occurs in one of the main heater 302*a* and sub heater 302*b*, the same operation as described in the first embodiment is performed. A case in which energization runaway occurs in the main heater 302*a* and sub heater 302*b* will be described next. In the print operation mode, the signal MOTDET output from the motor rotation detection circuit 554 goes low. Hence, the signal HEATCLK does low so that the driving signals S1 and S2 control the first and second triacs 502 and 503.

In the print operation mode, when energization runaway occurs in both the main heater 302*a* and sub heater 302*b*, the temperature of the ceramic heater 205 rises. However, as in the first embodiment, the heat generated by the ceramic heater 205 is dissipated to the rotating pressing roller 202. Hence, the temperature of the ceramic heater 205 moderately rises. It is therefore possible to prevent damage such as deformation or deterioration in the vicinity of the fixing apparatus 116 due to overheat of the ceramic heater 205.

Figure 15:
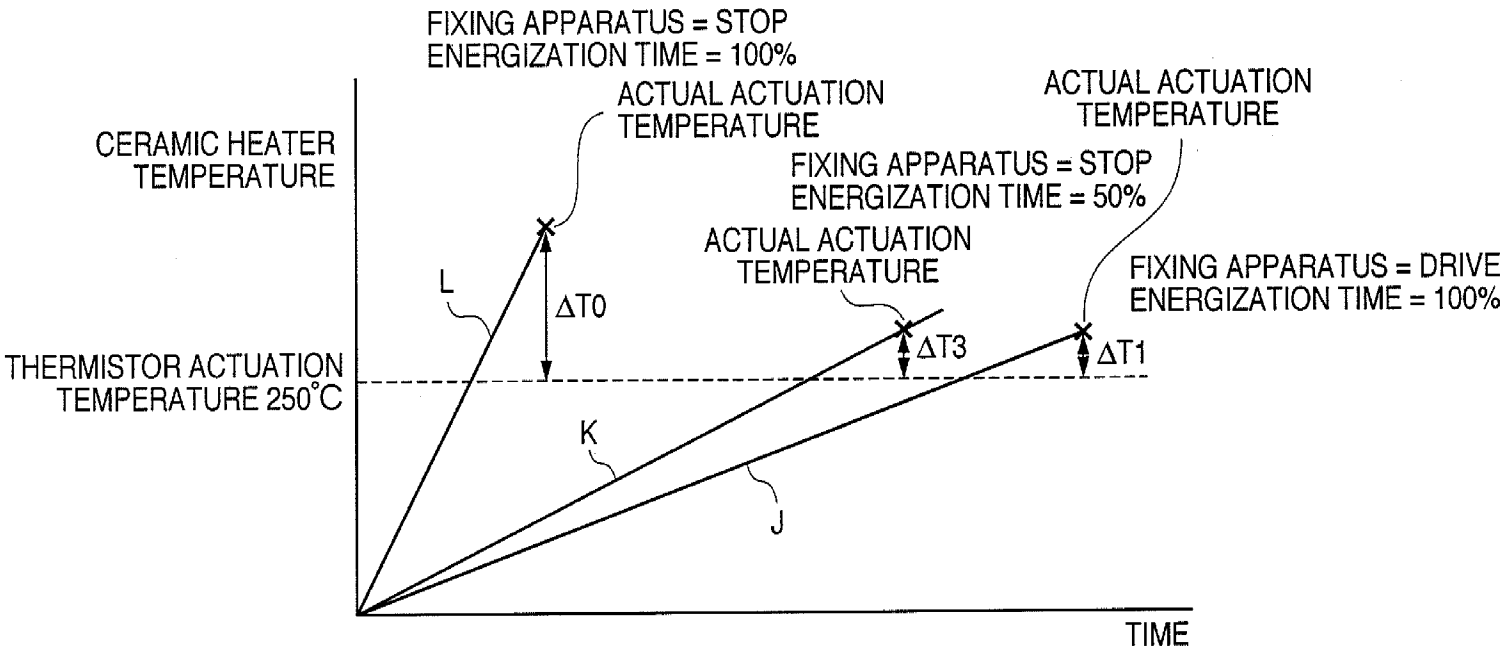
FIG. 15 is a graph showing a time-rate change in the temperature of a ceramic heater in energization runaway.

FIG. 15 is a graph showing a time-rate change in the temperature of the ceramic heater in energization runaway. A line J in FIG. 15 indicates the temperature rise of the ceramic heater 205 in the above-described print operation mode. In FIG. 15, "energization time=100%" indicates that the first and second triacs 502 and 503 are never forcibly turned off, i.e., switched to the OFF state.

Energization runaway in the standby mode will be described next. In the standby mode, the driving signal MOTDET output from the motor rotation detection circuit 554 goes high. Hence, the driving signal HEATCLK output from the AND circuit 1702 has the same waveform as the signal ZEROCLK.

When the driving signal HEATCLK is at low level, the driving signals S1 and S2 control the first and second triacs 502 and 503. When the driving signal HEATCLK is at high level, the first and second triacs 502 and 503 are forcibly turned off, i.e., switched to the OFF state independently of the driving signals S1 and S2. The signal ZEROCLK is obtained by halving the frequency of the zero-crossing signal. That is, the ceramic heater 205 receives the current during one period of the AC current supplied to the first and second triacs 502 and 503. In the next period, the ceramic heater 205 receives no current. This operation is repeated.

Figure 16:
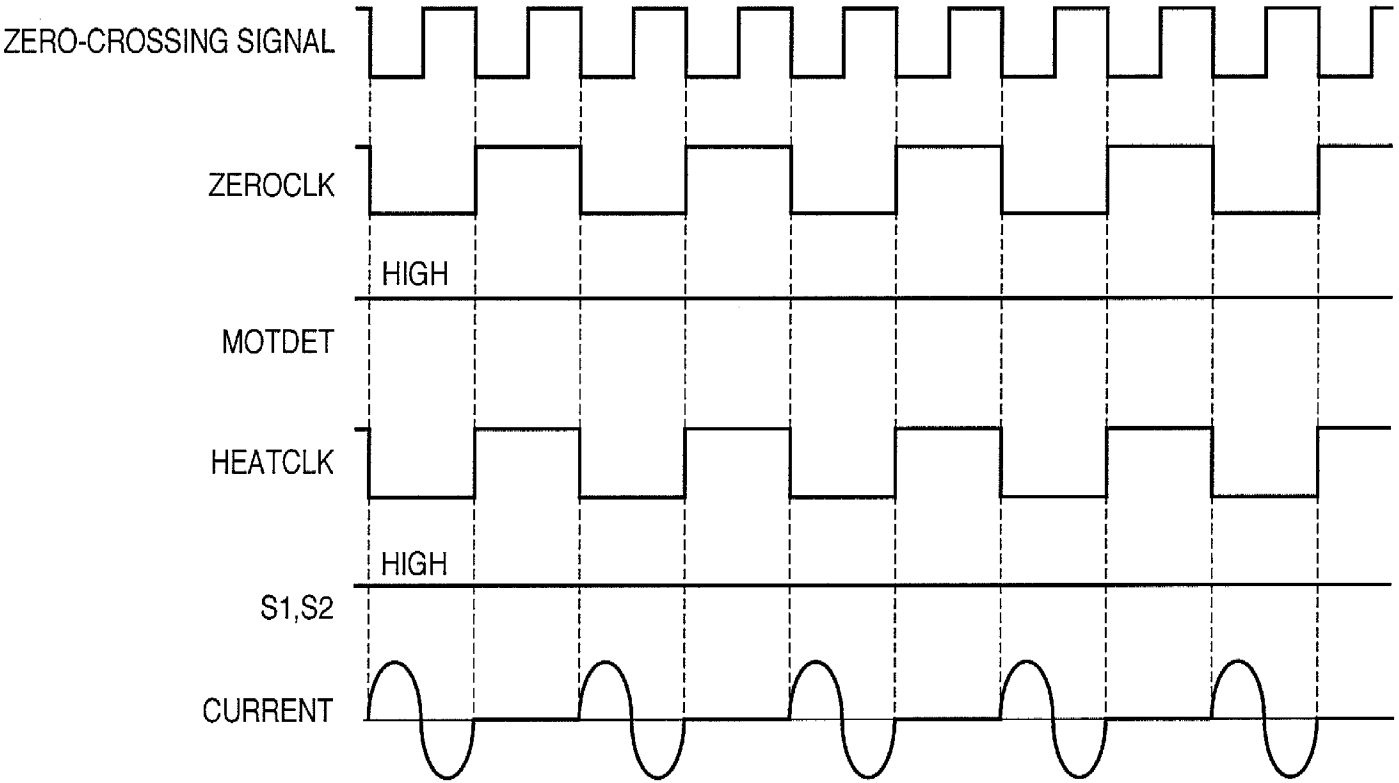
FIG. 16 is a timing chart showing a change in the current supplied from first and second triacs to the ceramic heater in a standby mode.
Figure 17:
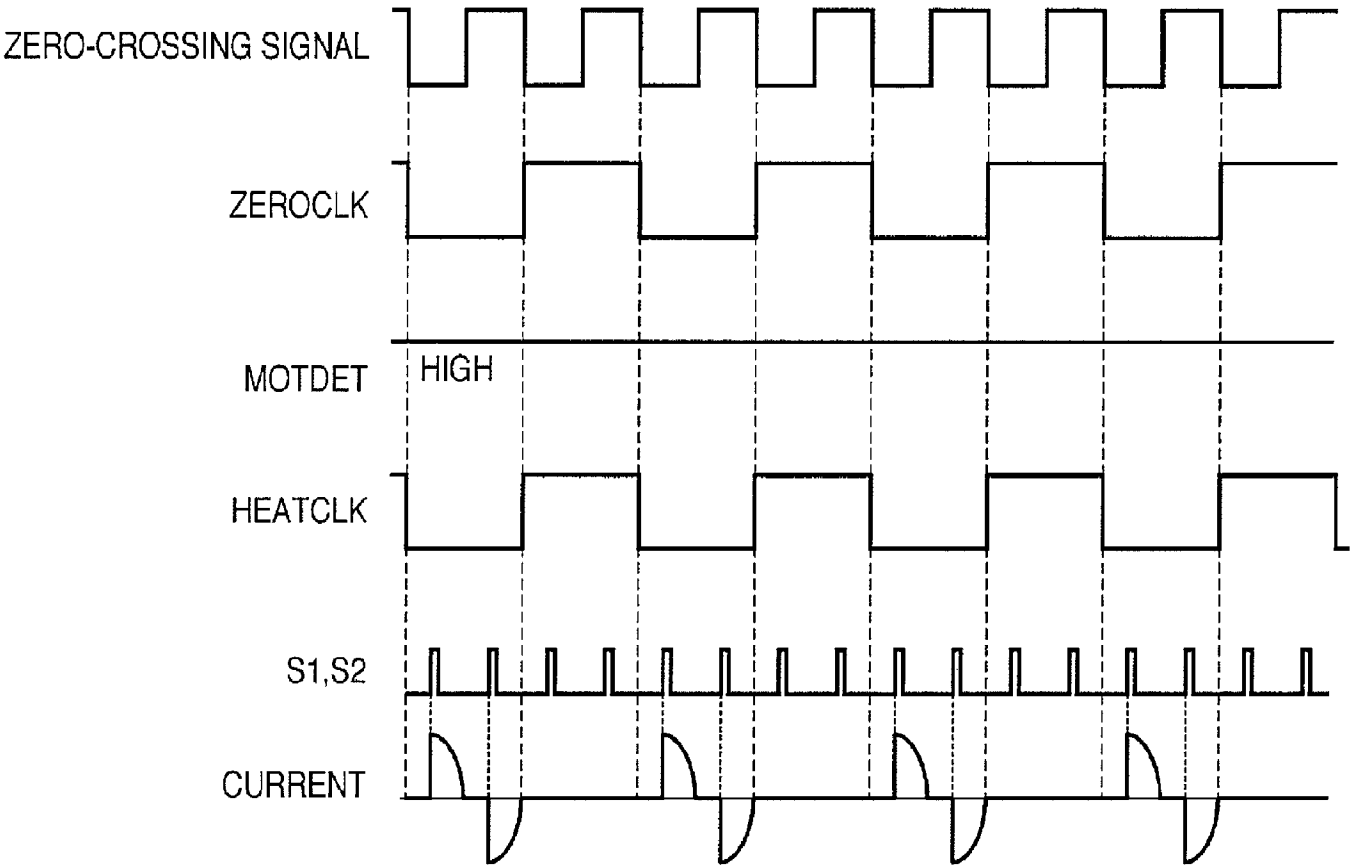
FIG. 17 is a timing chart showing the currents in FIG. 16 which have undergone phase control.

FIG. 16 is a timing chart showing a change in the current supplied from the first and second triacs 502 and 503 to the ceramic heater 205 in the standby mode. As shown in FIG. 16, the driving signal HEATCLK has the same waveform as the signal ZEROCLK obtained by halving the frequency of the zero-crossing signal because the signal MOTDET is at high level. If the driving signals S1 and S2 are constantly at high level, the current supplied to the ceramic heater 205 is 0 during the high-level period of the driving signal HEATCLK. As shown in FIG. 17, when the driving signals S1 and S2 are pulse signals, the current undergoes phase control. The current is 0 during the high-level period of the driving signal HEATCLK.

Referring back to FIG. 15, a line K indicates the temperature rise in the standby mode of this embodiment. In the standby mode, since the pressing roller 202 is at rest, the heat from the ceramic heater 205 is hardly dissipated. However, as shown in FIGS. 16 and 17, since the energization time of the ceramic heater 205 is suppressed to 50% of that in the print operation mode, the temperature of the ceramic heater 205 moderately rises. As a result, the actual actuation temperature of the thermal switch is only slightly higher than in the line J. It is therefore possible to prevent damage such as deformation or deterioration in the vicinity of the fixing apparatus 116 due to overheat of the ceramic heater 205.

A line L shown in FIG. 15 indicates a temperature rise when energization runaway in energization time=100% occurs in both the main heater 302*a* and sub heater 302*b* in the standby mode. That is, the line L is the same as the line I in FIG. 12. In this case, the temperature steeply rises, and the actual actuation temperature of the thermal switch is higher than in the lines J and K. This increases the risk of causing damage such as deformation or deterioration in the vicinity of the fixing apparatus 116.

As described above, the fixing apparatus 116 according to this embodiment periodically turns off the first and second triacs 502 and 503, i.e., switches the triacs to the OFF state in the standby mode in which the pressing roller 202 is at rest. Hence, even when energization runaway has occurred in the standby mode, it is possible to suppress the rate of temperature rise of the ceramic heater 205, actuate the thermal switch at a low temperature, and reduce the risk of causing damage such as deformation or deterioration in the vicinity of the fixing apparatus due to energization runaway. In the standby mode, the ceramic heater 205 is energized in a period of 50% of that in the print operation mode. It is therefore possible to control the temperature of the ceramic heater 205 and shorten the rise time to the print operation mode.

In this embodiment, an image forming apparatus which includes the fixing apparatus shown in FIG. 2, transfers a toner image formed on an image carrier onto a recording medium by electrophotography, causes a heat fixing means to heat and fix the image on the recording medium may be constituted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing apparatus comprising:

a first heating element;

a second heating element;

a first rotating member;

a second rotating member configured to form a fixing nip portion together with the first rotating member, wherein a printing medium is conveyed to the fixing nip portion, and an image formed on the printing medium is fixed onto the printing medium by heat from the first and second heating elements;

a first driving circuit configured to drive the first heating element;

a second driving circuit configured to drive the second heating element;

a control unit configured to control the first and second driving circuits;

a safety element configured to shut off a power supply path for supplying an electrical power to the first and second heating elements in response with an abnormal temperature;

a rotation detection circuit configured to detect a rotation state of the first and second rotating members; and a limiting circuit configured to limit a drive of the second driving circuit in accordance with an output from the rotation detection circuit, wherein the first driving circuit drives the first heating element in accordance with a control signal from the control unit, regardless of the rotation state of the first and second rotating members, and the second driving circuit drives the second heating element in accordance with a control signal from the control unit and the output from the rotation detection circuit.

2. The fixing apparatus according to claim 1, wherein, in response to the first and second rotating members not rotating, a driving of the second driving circuit is limited by the output from the rotation detection circuit.

3. The fixing apparatus according to claim 1, wherein the limiting circuit has a switching element which switches the second driving circuit between a drive-limited state and a drive-unlimited state in accordance with the output from the rotation detection circuit.

4. The fixing apparatus according to claim 1, wherein the rotation detection circuit detects a rotation state of a motor for driving the first and second rotating members.

5. The fixing apparatus according to claim 1, wherein, in a standby mode in which the first and second rotating members are not rotating and the fixing apparatus waits for a print instruction, the first heating element generates heat and the second heating element does not generate heat.

6. The fixing apparatus according to claim 1, wherein the first rotating member is a cylindrical film.

7. The fixing apparatus according to claim 6, wherein the first and second heating elements are assigned on a ceramic substrate and the ceramic substrate contacts to inner surface of the first rotating member.

8. A fixing apparatus comprising:

a heating element;

a first rotating member;

a second rotating member configured to form a fixing nip portion together with the first rotating member, wherein a printing medium is conveyed to the fixing nip portion, and an image formed on the printing medium is fixed onto the printing medium by heat from the heating element;

a driving circuit configured to drive the heating element;

a control unit configured to control the driving circuit;

a safety element configured to shut off a power supply path for supplying an electrical power to the first and second heating elements in response with an abnormal temperature;

a rotation detection circuit configured to detect a rotation state of the first and second rotating members;

a frequency dividing circuit configured to divide a frequency corresponding to the power supply; and a limiting circuit configured to limit a drive of the driving circuit in accordance with an output from the rotation detection circuit and an output from the frequency dividing circuit.

9. The fixing apparatus according to claim 8, wherein, in response to the first and second rotating members not rotating, a driving signal for driving the heating element is limited by the output from the frequency dividing circuit.

10. The fixing apparatus according to claim 9, wherein the limiting circuit has a switching element which periodically switches the driving circuit between a drive-limited state and a drive-unlimited state in accordance with the output from the rotation detection circuit and the output from the frequency dividing circuit.

11. The fixing apparatus according to claim 8, further comprising:

a zero-crossing detection circuit configured to detect a zero-crossing point of an alternating current of the power supply, wherein the frequency dividing circuit generates a signal based on the zero-crossing point detected by the zero-crossing detection circuit.

12. The fixing apparatus according to claim 8, wherein the rotation detection circuit detects a rotation state of a motor for driving the first and second rotating members.

13. The fixing apparatus according to claim 8, wherein, in a standby mode in which the first and second rotating members are not rotating and the fixing apparatus waits for a print instruction, the heating element generates heat based on a driving signal for controlling the driving circuit from the control unit, the output from the rotation detection circuit, and the output from the frequency dividing circuit.

14. The fixing apparatus according to claim 8, wherein the first rotating member is a cylindrical film.

15. The fixing apparatus according to claim 14, wherein the heating element is assigned on a ceramic substrate and the ceramic substrate contacts to inner surface of the first rotating member.

* * * * *